US009790610B2

(12) United States Patent
Kimoto et al.

(10) Patent No.: US 9,790,610 B2
(45) Date of Patent: Oct. 17, 2017

(54) ELECTRO PLATING DEVICE

(71) Applicants: NIPPON STEEL & SUMITOMO METAL CORPORATION, Tokyo (JP); VALLOUREC OIL AND GAS FRANCE, Aulnoye-Aymeries (FR)

(72) Inventors: Masanari Kimoto, Tokyo (JP); Kazuya Ishii, Tokyo (JP); Tatsuya Yamamoto, Tokyo (JP)

(73) Assignees: NIPPON STEEL & SUMITOMO METAL CORPORATION, Tokyo (JP); VALLOUREC OIL AND GAS FRANCE, Aulnoye-Aymeries (FR)

( * ) Notice: Subject to any disclaimer, the term of this patent is extended or adjusted under 35 U.S.C. 154(b) by 253 days.

(21) Appl. No.: 14/403,947

(22) PCT Filed: Jun. 24, 2013

(86) PCT No.: PCT/JP2013/067194
§ 371 (c)(1),
(2) Date: Nov. 25, 2014

(87) PCT Pub. No.: WO2014/007090
PCT Pub. Date: Jan. 9, 2014

(65) Prior Publication Data

US 2015/0136590 A1 May 21, 2015

(30) Foreign Application Priority Data

Jul. 2, 2012 (JP) ..... 2012-148476

(51) Int. Cl.
*C25D 7/04* (2006.01)
*C25D 17/12* (2006.01)
(Continued)

(52) U.S. Cl.
CPC ..... *C25D 7/04* (2013.01); *C25D 5/02* (2013.01); *C25D 5/022* (2013.01); *C25D 5/08* (2013.01); *C25D 17/12* (2013.01)

(58) Field of Classification Search
CPC ..... C25D 17/001; C25D 5/08; C25D 17/02; C25D 21/10; C25D 7/04; C25D 5/026; C25D 17/00; C25D 5/02; C25D 5/022
(Continued)

(56) References Cited

U.S. PATENT DOCUMENTS 3,673,073 A * 6/1972 Tobey ..... C25D 7/04 204/224 R
3,956,096 A * 5/1976 Paulson ..... C25D 7/04 204/237
(Continued)

FOREIGN PATENT DOCUMENTS

CN 1860260 A 11/2006
CN 201309972 Y 9/2009
(Continued)

OTHER PUBLICATIONS

Extended European Search Report for European Application No. 13812612.3, dated Jan. 25, 2016.
(Continued)

*Primary Examiner* — Harry D Wilkins, III
(74) *Attorney, Agent, or Firm* — Birch, Stewart, Kolasch & Birch, LLP

(57) ABSTRACT

An electro plating device includes a pipe inside seal mechanism which occludes an inner channel of a steel pipe, a tubular insoluble electrode which is disposed in a pipe end so as to be opposite to a female screw, a plating solution feed mechanism which includes a plurality of nozzles which extend radially with a pipe axis of the steel pipe as a center, and a pipe end seal mechanism which accommodates the
(Continued)

nozzles thereinside and is mounted to the pipe end, when viewed in the pipe axial direction, a tip of each of the nozzles is positioned between the female screw and the insoluble electrode, and each of the nozzles injects the plating solution toward a direction which intersects an extension direction of the nozzle, the direction being a rotational direction of a clockwise direction or a counterclockwise direction in which the pipe axis is the center.

12 Claims, 5 Drawing Sheets

(51) Int. Cl.
*C25D 5/02* (2006.01)
*C25D 5/08* (2006.01)

(58) Field of Classification Search
USPC ..... 204/275.1; 205/131
See application file for complete search history.

(56) References Cited

U.S. PATENT DOCUMENTS

| | | | | |
|---|---|---|---|---|
| 3,974,042 | A | 8/1976 | Angelini | |
| 5,002,649 | A | 3/1991 | Smith | |
| 5,620,575 | A * | 4/1997 | Karasawa | C25D 7/04 204/272 |
| 7,867,368 | B2 * | 1/2011 | Ogawa | C25D 5/08 204/272 |
| 2004/0262150 | A1 | 12/2004 | Yajima et al. | |
| 2007/0221495 | A1 * | 9/2007 | Manens | H01L 21/32125 204/212 |
| 2007/0235323 | A1 | 10/2007 | Lapelosa et al. | |
| 2007/0284256 | A1 | 12/2007 | Piper et al. | |
| 2013/0228122 | A1 * | 9/2013 | Sasaki | F16L 58/182 118/642 |
| 2016/0298251 | A1 * | 10/2016 | Kimoto | C25D 5/08 |

FOREIGN PATENT DOCUMENTS

| | | | |
|---|---|---|---|
| CN | 102453934 | A | 5/2012 |
| GB | 1 464 216 | A | 2/1977 |
| JP | 59-166694 | A | 9/1984 |
| JP | 61-133397 | A | 6/1986 |
| JP | 63-6637 | B2 | 2/1988 |
| JP | 2006-2206 | A | 1/2006 |
| JP | 2012-82450 | A | 4/2012 |
| WO | WO 2004/081261 | A2 | 9/2004 |

OTHER PUBLICATIONS

Australian Office Action, issued Aug. 3, 2015, for Australian Application No. 2013284698.

International Search Report, mailed Jul. 30, 2013, issued in PCT/JP2013/067194.

Written Opinion of the International Searching Authority, mailed Jul. 30, 2013, issued in PCT/JP2013/067194.

Japanese Notice of Allowance, dated Jan. 20, 2015, for Japanese Application No. 2014-523678, including an English translation.

Chinese Office Action and Chinese Search Report, issued Mar. 4, 2016, for Chinese Application No. 201380033201.5 are provided, along with a partial English translation of the Chinese Search Report.

* cited by examiner

ELECTRO PLATING DEVICE

TECHNICAL FIELD

The present invention relates to an electro plating device which forms an electro plating layer on a surface of a female screw carved on an inner circumferential surface of a pipe end of a steel pipe.

Priority is claimed on Japanese Patent Application No. 2012-148476, filed on Jul. 2, 2012, and the contents of which are incorporated herein by reference.

BACKGROUND ART

In order to collect natural gas or crude oil from underground, a pit is dug toward a natural gas field or an oil field existing at several thousand meters from the ground surface to underground, and it is necessary to install a large transport pipe to the pit. In the transport pipe, a plurality of long steel pipes (so-called oil-well pipes) are connected to each other in a line. In recent years, in the viewpoint of productivity improvement, a need for a screw joint (so-called integral joint) for a steel pipe capable of directly connecting the oil-well pipes without using a coupling is increasing. The oil-well pipe having a male screw formed on an outer circumferential surface of one pipe end and a female screw formed on an inner circumferential surface of the other pipe end is used as the integral joint. That is, the integral joint includes the male screw (pin) which is spirally carved on the outer circumferential surface of one pipe end of the oil-well pipe, and the female screw (box) which is spirally carved on the inner circumferential surface of one pipe end of the other oil-well pipe connected to the oil-well pipe.

Conventionally, when the oil-well pipes are secured to each other, in order to prevent seizure of the joint portion, lubricating oil (API dope) including heavy metals such as Pb is applied to at least one of the male screw and the female screw of the oil-well pipe. On the other hand, in a region in which use of the API dope is limited under a severe environmental regulation, environment protective lubricating oil (green dope) not including heavy metals may be used. Since lubricity of the green dope is worse than that of the API dope, the seizure easily occurs in the joint portion. Thereby, when the green dope is used as the lubricating oil, in order to compensate for lack of the lubricity of the green dope and prevent occurrence of the seizure, it is preferable that an electro plating layer such as copper be formed on at least one surface of the male screw and the female screw carved on the pipe end of the oil-well pipe.

For example, in Patent Document 1 below, a device is disclosed which forms an electro plating layer on a surface of a male screw (pin) carved on one pipe end of the oil-well pipe, that is, on an outer circumferential surface of one pipe end of the oil-well pipe.

PRIOR ART DOCUMENT

Patent Document

[Patent Document 1] Japanese Examined Patent Application, Second Publication No. S63-6637

DISCLOSURE OF THE INVENTION

Problem that the Invention is to Solve

When a coupling is used as a joint element, an electro plating layer is formed on a surface of a female screw carved on an inner circumferential surface of the coupling, and thus, reliability (seizure resistance) of a joint portion is improved. Also in an integral joint, in order to obtain the similar reliability, it is preferable that an electro plating layer be formed on a surface of a female screw (box) carved on an inner circumferential surface of one pipe end of an oil-well pipe.

In general, when the electro plating layer is formed, bubbles of hydrogen or oxygen are generated concurrently with the electro plating layer. As described in Patent Document 1, when the electro plating layer is formed on the surface of the male screw carved on the outer circumferential surface of the steel pipe, since bubbles are rapidly separated from the surface of the male screw, there is no problem. However, when the electro plating layer is formed on the surface of the female screw carved on the inner circumferential surface of the steel pipe, since separation of the bubbles is impeded due to an inner wall of the steel pipe, particularly, the bubbles easily remain in grooves of the female screw. The residual portion of the bubbles becomes an unplated region and becomes the cause which decreases seizure resistance of the joint portion.

The present invention is made in consideration of the above-described circumstance, and an object thereof is to provide an electro plating device capable of forming a uniform electro plating layer without an unplated region on the surface of the female screw carved on the inner circumferential surface of the pipe end of the steel pipe.

Means for Solving the Problems

The present invention adopts the following means in order to solve the above-described problems and achieve the related object. That is, (1) According to an aspect of the present invention, there is provided an electro plating device which forms an electro plating layer on a surface of a female screw carved on an inner circumferential surface of a pipe end of a steel pipe, including: a pipe inside seal mechanism which occludes an inner channel of the steel pipe at a position distanced from the female screw in a pipe axial direction of the steel pipe; a tubular insoluble electrode which is disposed in the pipe end so as to be opposite to the female screw; a plating solution feed mechanism which includes a plurality of nozzles which extend radially with a pipe axis of the steel pipe as a center and is disposed outside the pipe end; and a pipe end seal mechanism which accommodates the nozzles thereinside and is mounted to the pipe end in a state where the pipe end seal mechanism closely contacts an outer circumferential surface of the pipe end, and when viewed in the pipe axial direction, a tip of each of the nozzles is positioned between the female screw and the insoluble electrode, and each of the nozzles injects the plating solution from an injection port formed on the tip toward a direction which intersects an extension direction of the nozzle, the direction being a rotational direction of a clockwise direction or a counterclockwise direction in which the pipe axis is the center.

(2) In the electro plating device according to (1), each of the nozzles may be perpendicular to the pipe axial direction or be inclined toward the pipe end side.

(3) In the electro plating device according to (1), each of the nozzles may be perpendicular to the pipe axial direction, and each of the nozzles may inject the plating solution in a reference direction perpendicular to the pipe axial direction and the extension direction when viewed in the extension direction of the nozzle or inject the plating solution in a direction which is inclined from the reference direction to the pipe end side.

(4) In the electro plating device according to any one of (1) to (3), the plating solution feed mechanism may include three nozzles.

(5) In the electro plating device according to any one of (1) to (4), the pipe end seal mechanism may further include: a discharging port for discharging a used plating solution; and a liquid discharge promotion mechanism for promoting discharging of the used plating solution.

(6) In the electro plating device according to (5), the liquid discharge promotion mechanism may be an atmosphere opening portion which is disposed at a position above the steel pipe in the pipe end seal mechanism.

Effects of the Invention

According to the above-described aspects, a uniform electro plating layer can be formed without an unplated region on the surface of the female screw carved on the inner circumferential surface of the pipe end of the steel pipe.

BEST MODE FOR CARRYING OUT THE INVENTION

Hereinafter, an embodiment of the present invention will be described in detail with reference to drawings or the like.

Figure 1:
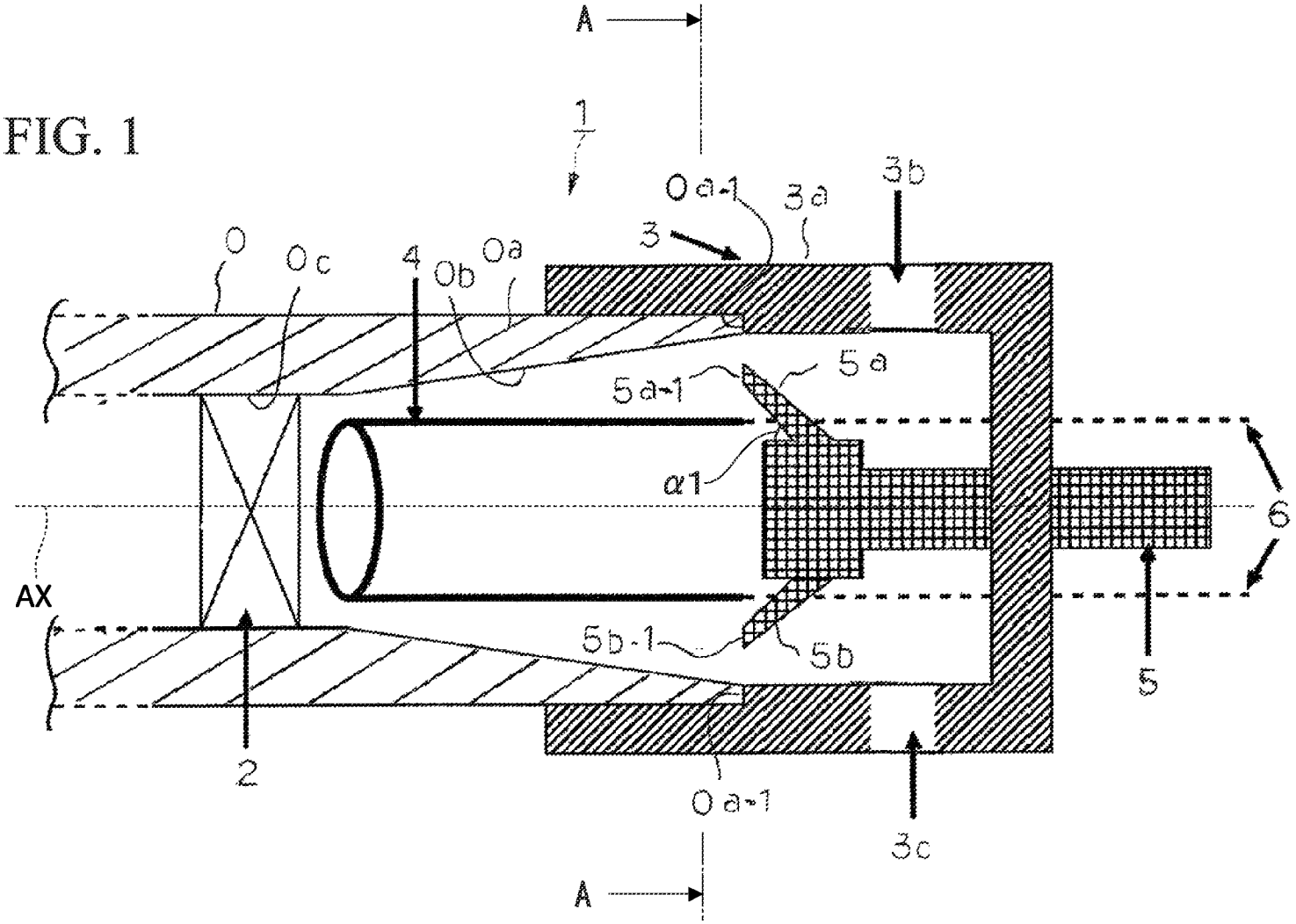
FIG. 1 is an explanatory view conceptually showing a configuration of an electro plating device according to an embodiment of the present invention.

FIG. 1 is an explanatory view conceptually showing a configuration of an electro plating device 1 according to an embodiment of the present invention.

As shown in FIG. 1, the electro plating device 1 according to the present embodiment is a device which forms an electro plating layer on a surface of a female screw 0*b* spirally carved on an inner circumferential surface of one pipe end 0*a* of a cylindrical steel pipe 0. In FIG. 1, a state where the steel pipe 0 is disposed approximately horizontally is exemplified. In descriptions below, a case where the steel pipe 0 is a long seamless oil-well pipe is exemplified. Moreover, a reference numeral AX in the drawing indicates a pipe axis (central axis) of the steel pipe 0.

The electro plating device 1 includes a pipe inside seal mechanism 2, a pipe end seal mechanism 3, an insoluble electrode 4, and a plating solution feed mechanism 5. Hereinafter, the details of each component of the electro plating device 1 will be described sequentially.

[Pipe Inside Seal Mechanism 2]

The pipe inside seal mechanism 2 is disposed at a predetermined position 0*c* inside in a pipe axial direction (a direction along the pipe axis AX in FIG. 1) of the steel pipe 0 from a female screw 0*b* of the steel pipe 0. The pipe inside seal mechanism 2 contacts the steel pipe 0 in a sealing state at the predetermined position 0*c*. In other words, the pipe inside seal mechanism 2 occludes an inner channel of the steel pipe 0 at the predetermined position 0*c*.

For example, as the pipe inside seal mechanism 2, a hex plug which is used in piping work may be used. As is well known, the hex plug has a structure which occludes an inner channel of a tubular member by inserting a rubber ring between two plates and expanding the diameter of the rubber ring. Moreover, the pipe inside seal mechanism 2 is not limited to the hex plug and may be any device if having a structure capable of occluding the inner channel of the steel pipe 0.

Since the pipe inside seal mechanism 2 is well known by a person skilled in the art, further descriptions with respect to the pipe inside seal mechanism 2 are omitted.

[Pipe End Seal Mechanism 3]

The pipe end seal mechanism 3 includes a tubular main body 3*a* which accommodates plating solution injection nozzles 5*a*, 5*b*, and 5*c* included in the plating solution feed mechanism 5 described below thereinside and includes an inner surface shape which can be mounted in a state where the main body 3*a* closely contacts an outer circumferential surface and an end surface of the pipe end 0*a* of the steel pipe 0.

The pipe end seal mechanism 3 is mounted to the pipe end 0*a* in the state where the main body 3*a* closely contacts the outer circumferential surface and the end surface of the pipe end 0*a* of the steel pipe 0, and thus, the pipe end seal mechanism 3 seals the inside of the pipe end 0*a* of the steel pipe 0 along with the pipe inside seal mechanism 2.

A liquid discharge port 3*c* and a liquid discharge promotion mechanism 3*b* are disposed in the main body 3*a* of the pipe end seal mechanism 3.

The liquid discharge port 3*c* discharges plating solution alter the plating solution is used for formation of the electro plating layer, and is disposed at a position lower than the steel pipe 0 when the pipe end seal mechanism 3 is mounted to the steel pipe 0.

The liquid discharge promotion mechanism 3*b* promotes discharging of used plating solution. The liquid discharge promotion mechanism 3*b* is not limited to a specific type if it can promote the discharging of the plating solution, and as shown in FIG. 1, is preferably an atmosphere opening port 3*b* which is disposed at a position above the steel pipe 0 in the pipe end seal mechanism 3.

A configuration may be adopted in which an electromagnetic valve (not shown) is disposed at the atmosphere opening port 3*b* and the atmosphere opening port 3*b* is opened and closed. Alternatively, a hose is mounted to the atmosphere opening port 3*b*, the hose is extended upward, and it may prevent the liquid from being blown outside the main body 3*a* by balancing pressure of liquid inserted by a pump and the weight of the liquid itself. Alternatively, the discharging of the used plating solution may be promoted by feeding compressed air from the atmosphere opening port 3*b* to the inner portion of the pipe end 0*a*, or the like.

If the used plating solution is not rapidly discharged after the electro plating layer is formed, the electro plating layer may corrode and color of the layer may be changed. However, as described above, since the atmosphere opening port 3*b* is provided in the pipe end seal mechanism 3 and thus, the used plating solution is rapidly discharged, the change of color of the surface of the electro plating layer formed on the female screw 0*b* can be suppressed.

[Insoluble Electrode 4]

The insoluble electrode 4 is a hollow cylindrical electrode (anode) for forming the electro plating layer on the female screw 0*b* and is disposed in the pipe end 0*a* of the steel pipe 0 so as to be opposite to the female screw 0*b*. It is preferable that the central axis of the insoluble electrode 4 be disposed so as to coincide with the pipe axis AX of the steel pipe 0. That is, when viewed in the pipe axial direction of the steel pipe 0, it is preferable that the steel pipe 0 and the insoluble electrode 4 have a concentric relationship. The insoluble electrode 4 is disposed in this way, and thus, an electro plating layer having high uniformity can be formed on the surface of the female screw 0*b* which is carved on the inner circumferential surface of the pipe end 0*a*.

As the insoluble electrode 4, it is preferable that an electrode, in which an iridium oxide coating titanium plate or stainless steel plate, or the like is formed in a cylindrical shape, be used.

An energizing bar 6 for energizing the insoluble electrode 4 penetrates the main body 3*a* of the pipe end seal mechanism 3 and is connected to the insoluble electrode 4. For example, a titanium bar, a stainless steel bar, or the like may be used as the energizing bar 6.

If a potential difference is applied between the insoluble electrode 4 and the steel pipe 0 while the plating solution is supplied between the female screw 0*b* and the insoluble electrode 4 by the plating solution feed mechanism 5 described below, the electro plating layer is formed on the surface of the female screw 0*b*.

Since the insoluble electrode 4 is well known by a person skilled in the art, further descriptions with respect to the insoluble electrode 4 are omitted.

[Plating Solution Feed Mechanism 5]

The plating solution feed mechanism 5 supplies the plating solution to the inside of the pipe end 0*a* of the steel pipe 0 and is supported at a position outside the pipe end 0*a* by a supporting mechanism (not shown) which is provided on the pipe end seal mechanism 3.

Hereinafter, a configuration of the plating solution feed mechanism 5 will be described in detail with reference to FIGS. 1 and 2. Moreover, FIG. 2 is a cross-section view taken along line A-A of FIG. 1 (that is, a view when is viewed outside of the steel pipe 0 from inside of the steel pipe 0 in the pipe axial direction of the steel pipe 0).

Figure 2:
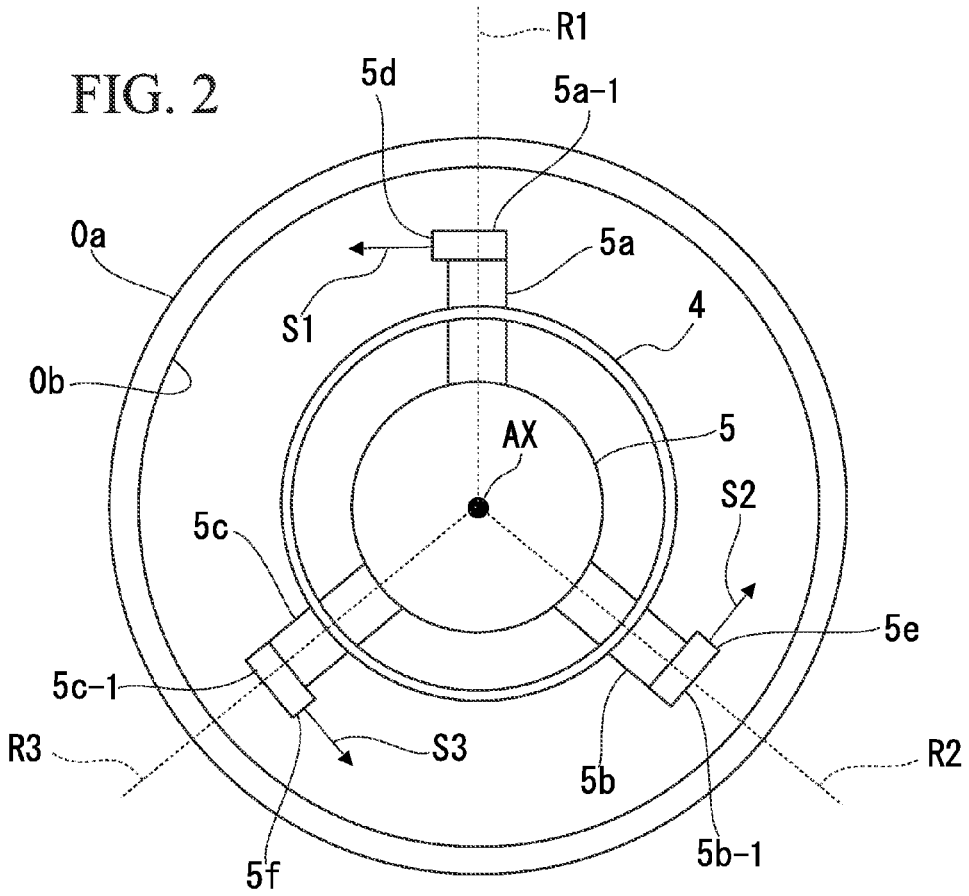
FIG. 2 is a cross-section view taken along line A-A of FIG. 1 (a view when viewed in a pipe axial direction of a steel pipe 0).

As shown in FIGS. 1 and 2, the plating solution feed mechanism 5 includes a plurality of (three as an example in the present embodiment) plating solution injection nozzles 5*a*, 5*b*, and 5*c* which extend radially with the pipe axis AX of the steel pipe 0 as the center. As shown in FIG. 2, when viewed in the pipe axial direction of the steel pipe 0, tips (refer to reference numerals 5*a*-1, 5*b*-1, and 5*c*-1 in FIG. 2) of the respective plating solution injection nozzles 5*a*, 5*b*, and 5*c* are disposed between the female screw 0*b* and the insoluble electrode 4.

In addition, when viewed in the pipe axial direction of the steel pipe 0, the respective plating solution injection nozzles 5*a*, 5*b*, and 5*c* inject the plating solution from injection ports (refer to reference numerals 5*d*, 5*e*, and 5*f* in FIG. 2) formed on each tip of the nozzles toward directions which intersect extension directions (refer to reference numerals R1, R2, and R3 in FIG. 2) of the plating solution injection nozzles, the directions being rotational directions of a clockwise direction or a counterclockwise direction in which the pipe axis AX is the center. Hereinafter, the directions in which the plating solution is injected from the respective plating solution injection nozzles 5*a*, 5*b*, and 5*c* are referred to as plating solution injection directions (refer to reference numerals S1, S2, and S3 in FIG. 2).

Moreover, as described above, the respective plating solution injection directions S1, S2, and S3 may be set to the rotational direction of any one of the clockwise direction and the counterclockwise direction in which the pipe axis AX is the center. However, in order to suppress the occurrence of the unplated regions effectively, it is preferable that the respective plating solution injection directions S1, S2, and S3 are set to the same rotational direction of the clockwise direction or the counterclockwise direction as a screw cutting direction of the female screw 0*b*.

As shown in FIG. 2, the extension direction R1 of the plating solution injection nozzle 5*a* intersects the plating solution injection direction S1. However, both (R1 and S1) do not necessarily intersect each other in a state where both are perpendicular to each other. In other words, an intersection angle between the extension direction R1 of the plating solution injection nozzle 5*a* and the plating solution injection direction S1 is not limited to 90°, and may be appropriately set according to the dimensions of the steel pipe 0 and the insoluble electrode 4 or the like so that a uniform electro plating layer is formed on the surface of the female screw 0*b*.

A relationship between the extension direction R2 of the plating solution injection nozzle 5*b* and the plating solution injection direction S2 and a relationship between the extension direction R3 of the plating solution injection nozzle 5*c* and the plating solution injection direction S3 are similar to the above.

In addition, for example, when the screw cutting direction of the female screw 0*b* is the clockwise direction, it is preferable that all of the plating solution injection directions S1, S2, and S3 are set so as to face the rotational direction of the clockwise direction in which the pipe axis AX is the center.

Moreover, an angle between adjacent plating solution injection nozzles may be appropriately set according to the total number of the plating solution injection nozzles. For example, in the present embodiment, when the total number of the plating solution injection nozzles is 3, the angle between the adjacent plating solution injection nozzles may be set to 120°.

In addition, as shown in FIG. 1, when viewed in the direction perpendicular to the pipe axial direction of the steel pipe 0, the respective plating solution injection nozzles 5*a*, 5*b*, and 5*c* are inclined toward the pipe end 0*a* side. In order words, the extension directions R1, R2, and R3 of the respective plating solution injection nozzles 5*a*, 5*b*, and 5*c* are inclined with respect to the pipe axis AX of the steel pipe 0.

For example, it is preferable that an inclined angle (reference numeral $\alpha 1$ in FIG. 1) between the plating solution injection nozzle 5*a* (extension direction R1) and the pipe axis AX be appropriately set according to the dimensions of the steel pipe 0 and the insoluble electrode 4 or the like so that a uniform electro plating layer is formed on the surface of the female screw 0*b*. According to examination conducted by the inventors, it was established that the electro plating layer having high uniformity was formed if the inclined angle $\alpha 1$ was set to a range equal to or more than 45° and less than 90°.

Moreover, the plating solution injection nozzle 5*a* (extension direction R1) may be perpendicular to the pipe axial direction of the steel pipe 0 (that is, inclined angle $\alpha 1$=90°). Also in this case, it was established that the electro plating layer having high uniformity was formed.

A relationship between the plating solution injection nozzle 5*b* and the pipe axis AX and a relationship between the plating solution injection nozzle 5*c* and the pipe axis AX are similar to the above.

According to the electro plating device 1 of the present embodiment described above, the uniform electro plating layer can be formed without an unplated region on the surface of the female screw 0*b* carved on the inner circumferential surface of the pipe end 0*a* of the steel pipe 0. Hereinafter, the reasons will be described.

When the electro plating layer is formed on the screw surface of the steel pipe 0, a method which separates bubbles by applying a jet of the plating solution is generally known. For example, in the related art disclosed in Patent Document 1, it is possible to apply the jet of the plating solution by increasing a supply amount of the plating solution.

However, the plating surface is a surface of a screw and includes thread ridges and thread bottoms. Thereby, the jet is weak at thread bottoms while the jet is strong near the surfaces of thread ridges. Since hydrogen gas or oxygen gas generated when the electro plating layer is formed are minute bubbles, the bubbles accumulated in the thread bottoms are not separated from the thread bottoms until the minute bubbles are collected in the thread bottoms (grooves of the screw) and become large bubbles. The unplated region which really occurs is a small dot-like region. Moreover, the screw which is used for fastening members is formed in a three-dimensional spiral shape.

As the method which separates minute bubbles from thread bottoms, the inventors found a method which feeds the plating solution by a spiral jet between the surface of the female screw 0*b* and the insoluble electrode 4 by a plurality of, that is, two or more plating solution injection nozzles. However, when a single plating solution injection nozzle is used, sufficient jet effects cannot be obtained.

Moreover, even when three plating solution injection nozzles are installed on the tips of the supply port, if the plating solution injection direction of each plating solution injection nozzle is not appropriate, a pressure balance between the plating solution injection nozzles cannot be appropriately adjusted, and sufficient jet effects cannot be obtained.

Therefore, the plurality of plating solution injection nozzles are disposed at the supply port of the center of the pipe end 0*a* of the steel pipe 0, and a uniform spiral jet can be obtained by adjusting the plating solution injection directions of each of the plating solution injection nozzles.

Specifically, as shown in FIGS. 1 and 2, the tips of the respective plating solution injection nozzles 5*a*, 5*b*, and 5*c* are inclined to the pipe axis AX of the steel pipe 0 to be plated. It is preferable that three or more plating solution injection nozzles be provided. Moreover, it is preferable that the plating solution injection directions S1, S2, and S3 of the plating solution injection nozzles 5*a*, 5*b*, and 5*c* be set so that the spiral jet is formed in the same rotational direction as the screw cutting direction of the surface of the female screw 0*b* to be plated.

It is preferable that tips of the respective plating solution injection nozzles 5*a*, 5*b*, and 5*c* be positioned at the outside of the steel pipe 0 from the tip of the female screw 0*b*, that is, a tip 0*a*-1 of the pipe end 0*a* of the steel pipe 0 so that bubbles are separated from the entire region of the surface of the female screw 0*b*.

Moreover, it is preferable that the tip surfaces of respective plating solution injection nozzles 5*a*, 5*b*, and 5*c* be positioned between the female screw 0*b* and the insoluble electrode 4 in a radial direction of the steel pipe 0.

The tips of the respective plating solution injection nozzles 5*a*, 5*b*, and 5*c* are linearly formed toward the female screw 0*b*. However, for example, a portion of the tip including the tip surface of each of the plating solution injection nozzles 5*a*, 5*b*, and 5*c* may be inclined toward the outside in the radial direction of the steel pipe 0 according to the diameter of the steel pipe 0, the dimensions of the female screw 0*b*, or the like in order to increase uniformity of the spiral jet which is formed between the female screw 0*b* and the insoluble electrode 4. In addition, even in the case where a portion of the tip including the tip surface of each of the plating solution injection nozzles 5*a*, 5*b*, and 5*c* is not inclined toward the outside in the radial direction of the steel pipe 0, when the steel pipe 0 which is electro-plated is changed, it is preferable that orientation directions (plating solution injection directions) of the respective plating solution injection nozzles 5*a*, 5*b*, and 5*c* be appropriately corrected according to the diameter of the steel pipe 0, the dimensions of the female screw 0*b*, or the like.

As described above, in the electro plating device 1 of the present embodiment, since a uniform spiral jet can be formed between the female screw 0*b* and the insoluble electrode 4, the bubbles remaining on the thread bottoms of the female screw 0*b* can be effectively removed.

Therefore, according to the electro plating device 1 of the present embodiment, the uniform electro plating layer can be formed without an unplated region on the surface of the female screw 0*b* carved on the inner circumferential surface of the pipe end 0*a* of the steel pipe 0.

In addition, according to the electro plating device 1 of the present embodiment, since the atmosphere opening port 3*b* is provided in the pipe end seal mechanism 3 and thus, the used plating solution is rapidly discharged, the change of color of the surface of the electro plating layer formed on the female screw 0*b* can be suppressed.

Figure 3:
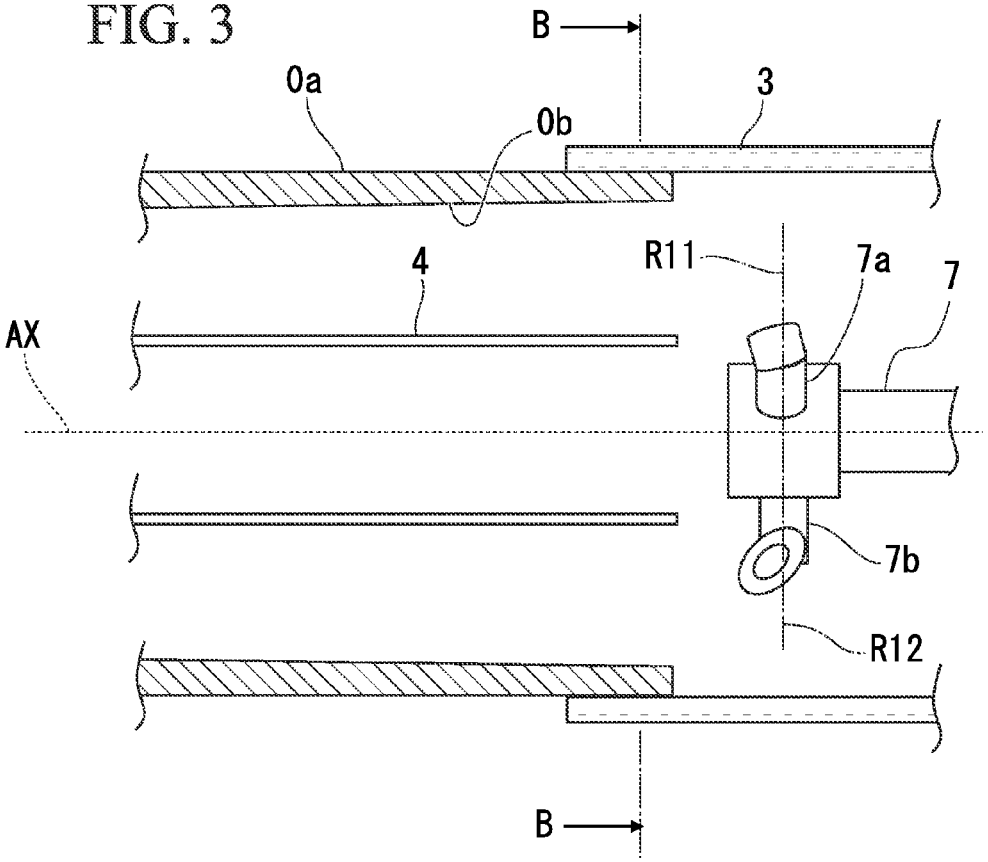
FIG. 3 is a view when a plating solution feed mechanism 7 in modification example is viewed in a direction perpendicular to the pipe axial direction of the steel pipe 0.
Figure 4:
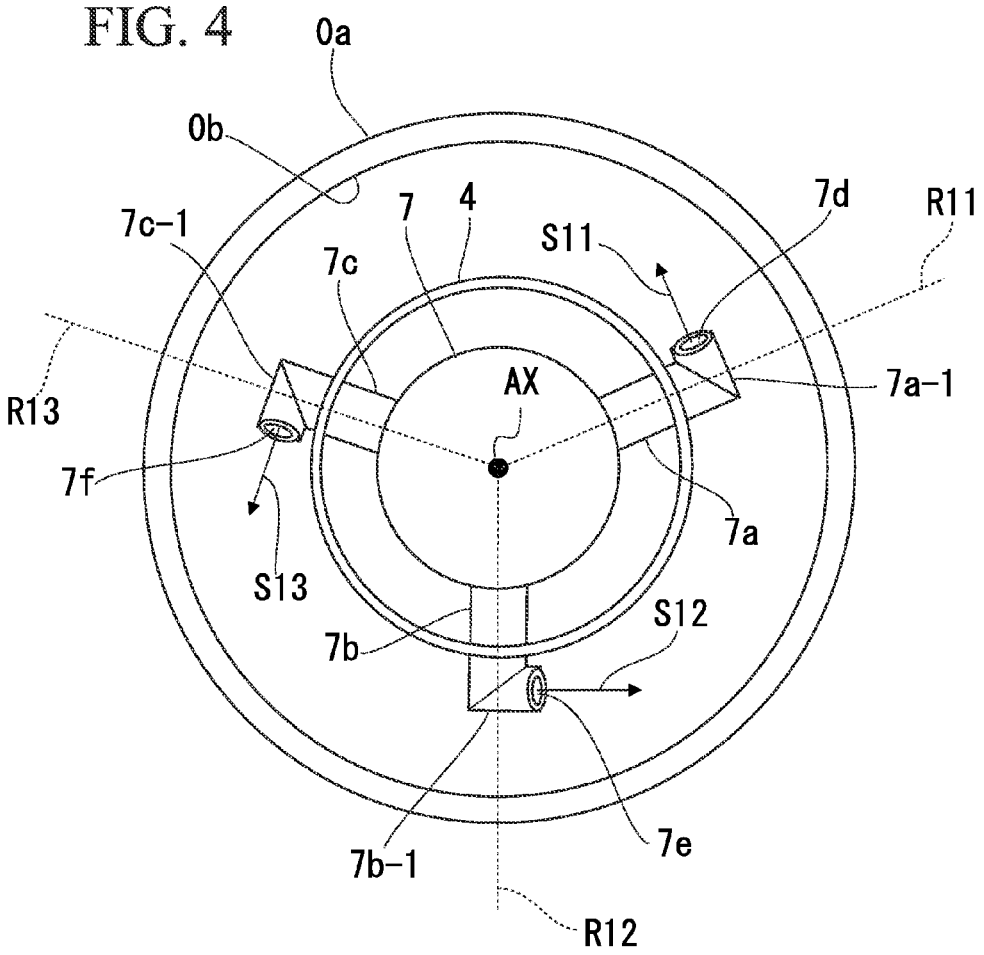
FIG. 4 is a cross-section view taken along line B-B of FIG. 3 (a view when viewed in a pipe axial direction of a steel pipe 0).

Moreover, the present invention is not limited to the above-described embodiment, and there may be modification example below. For example, instead of the plating solution feed mechanism 5 shown in FIGS. 1 and 2, a plating solution feed mechanism 7 including a configuration shown in FIGS. 3 and 4 may be used. FIG. 3 is a view when the plating solution feed mechanism 7 in Modification Example is viewed in a direction perpendicular to the pipe axial direction of the steel pipe 0. FIG. 4 is a cross-section view taken along line B-B of FIG. 3 (that is, a view when is viewed outside of the steel pipe 0 from inside of the steel pipe 0 in a pipe axial direction of a steel pipe 0).

As shown in FIGS. 3 and 4, the plating solution feed mechanism 7 of Modification Example includes a plurality of (three as an example in the present embodiment) plating solution injection nozzles 7*a*, 7*b*, and 7*c* which extend radially with the pipe axis AX of the steel pipe 0 as the center. As shown in FIG. 4, when viewed in the pipe axial direction of the steel pipe 0, tips (refer to reference numerals 7*a*-1, 7*b*-1, and 7*c*-1 in FIG. 4) of the respective plating solution injection nozzles 7*a*, 7*b*, and 7*c* are disposed between the female screw 0*b* and the insoluble electrode 4.

In addition, when viewed in the pipe axial direction of the steel pipe 0, the respective plating solution injection nozzles 7*a*, 7*b*, and 7*c* inject the plating solution from injection ports (refer to reference numerals 7*d*, 7*e*, and 7*f* in FIG. 4) formed on each tip of the nozzles toward directions which intersect extension directions (refer to reference numerals R11, R12, and R13 in FIG. 4) of the plating solution injection nozzles, the directions being rotational directions of the clockwise direction or the counterclockwise direction in which the pipe axis AX is the center. Hereinafter, the directions in which the plating solution is injected from the respective plating solution injection nozzles 7*a*, 7*b*, and 7*c* are referred to as plating solution injection directions (refer to reference numerals S11, S12, and S13 in FIG. 4).

Moreover, as described above, the respective plating solution injection directions S11, S12, and S13 may be set to the rotational direction of any one of the clockwise direction and the counterclockwise direction in which the pipe axis AX is the center. However, in order to suppress the occurrence of the unplated regions effectively, it is preferable that the respective plating solution injection directions S11, S12, and S13 are set to the same rotational direction of the clockwise direction or the counterclockwise direction as the screw cutting direction of the female screw 0*b*.

As shown in FIG. 4, the extension direction R11 of the plating solution injection nozzle 7*a* intersects the plating solution injection direction S11. However, both (R11 and S11) do not necessarily intersect each other in a state where both are perpendicular to each other. In other words, an intersection angle between the extension direction R11 of the plating solution injection nozzle 7*a* and the plating solution injection direction S11 is not limited to 90°, and may be appropriately set according to the dimensions of the steel pipe 0 and the insoluble electrode 4 or the like so that a uniform electro plating layer is formed on the surface of the female screw 0*b*.

A relationship between the extension direction R12 of the plating solution injection nozzle 7*b* and the plating solution injection direction S12 and a relationship between the extension direction R13 of the plating solution injection nozzle 7*c* and the plating solution injection direction S13 are similar to the above.

In addition, for example, when the screw cutting direction of the female screw 0*b* is the right-handed rotation, it is preferable that all of the plating solution injection directions S11, S12, and S13 are set so as to face the rotational direction of the clockwise direction in which the pipe axis AX is the center.

Moreover, an angle between adjacent plating solution injection nozzles may be appropriately set according to the total number of the plating solution injection nozzles. As shown in FIG. 4, when the total number of the plating solution injection nozzles is 3, the angle between the adjacent plating solution injection nozzles may be set to 120°.

In addition, as shown in FIG. 3, when viewed in the direction perpendicular to the pipe axial direction of the steel pipe 0, the respective plating solution injection nozzles 7*a*, 7*b*, and 7*c* are perpendicular to the pipe axial direction of the steel pipe 0. In other words, the extension directions R11, R12, and R13 of the respective plating solution injection nozzles 7*a*, 7*b*, and 7*c* are perpendicular to the pipe axial direction of the steel pipe 0.

Figure 5:
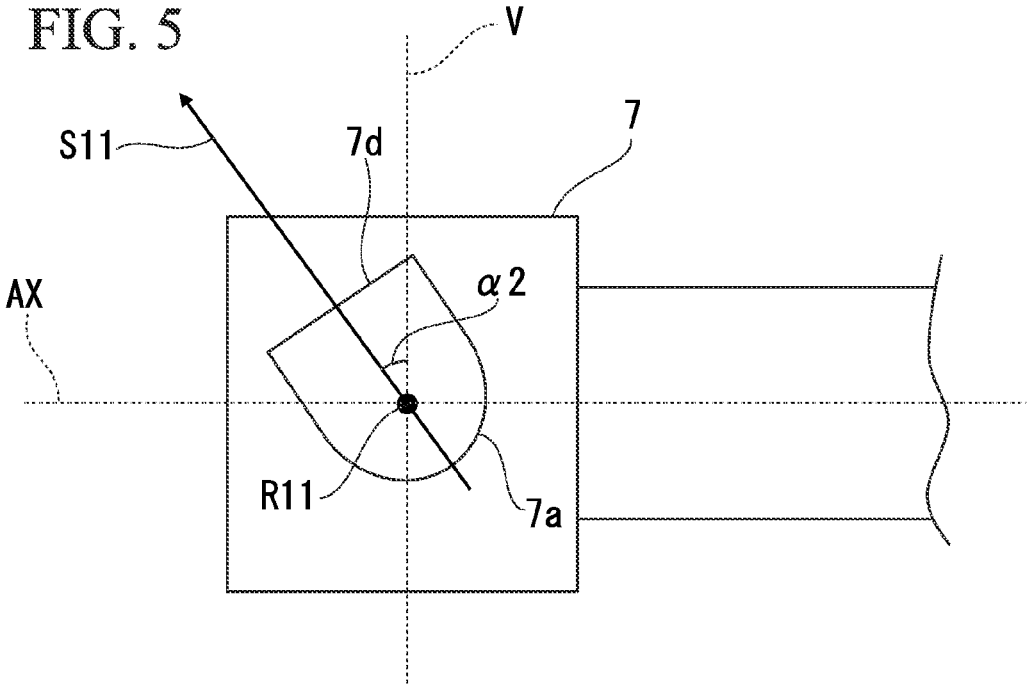
FIG. 5 is a view when a plating solution injection nozzle 7*a* is viewed in an extension direction R11 thereof.

In addition, for example, as shown in FIG. 5, when viewed in the extension direction R11 of the plating solution injection nozzle 7*a*, the plating solution injection nozzle 7*a* injects the plating solution toward the direction which is inclined from a reference direction V perpendicular to the pipe axial direction and the extension direction R11 to the pipe end 0*a* side.

That is, when viewed in the extension direction R11 of the plating solution injection nozzle 7*a*, the plating solution injection direction S11 of the plating solution injection nozzle 7*a* is inclined from the reference direction V to the pipe end 0*a* side.

It is preferable that an inclined angle (reference numeral α2 in FIG. 5) between the plating solution injection direction S11 of the plating solution injection nozzle 7*a* and the reference direction V be appropriately set according to the dimensions of the steel pipe 0 and the insoluble electrode 4 or the like so that a uniform electro plating layer is formed on the surface of the female screw 0*b*. According to examination conducted by the inventors, it was established that uniform electro plating layer was formed without an unplated region if the inclined angle α2 was set to a range more than 0° and less than or equal to 45° (more preferably, a range more than 0° and less than or equal to 20°).

In addition, the plating solution injection nozzle 7*a* may inject the plating solution in the reference direction V. In this case, the plating solution injection direction S11 of the plating solution injection nozzle 7*a* and the reference direction V coincide with each other (that is, the inclined angle α2=0°). Also in this case, it was established that the electro plating layer having high uniformity was formed. The plating solution injection nozzles 7*b* and 7*c* are also similar to the above.

EXAMPLE

Hereinafter, Examples of the present invention will be described.

A degreasing liquid (sodium hydroxide=50 g/L), a Ni-strike bath (nickel chloride=250 g/L and hydrochloric acid=80 g/L), and a copper plating bath (copper sulfate=250 g/L and sulfuric acid=110 g/L) were prepared, and copper plating was performed by processes and conditions shown in Table 1 using the electro plating device 1 shown in FIG. 1.

TABLE 1

| Process | | | | | | | | |
|---|---|---|---|---|---|---|---|---|
| Cathode Electrolytic Degreasing | | | Ni-Strike Treatment Condition | | | Copper plating | | |
| Bath Temperature (° C.) | Current Density (A/dm$^2$) | Treatment Time (second) | Bath Temperature (° C.) | Current Density (A/dm$^2$) | Treatment Time (second) | Bath Temperature (° C.) | Current Density (A/dm$^2$) | Treatment Time (second) |
| 50 | 6 | 60 | 35 | 6 | 120 | 50 | 8 | 400 |

By changing the plating solution injection nozzle type, the number of the plating solution injection nozzles, and the presence or absence of the atmosphere opening port, the presence or absence of an unplated region (Good: None, Normal: Slight Occurrence, and Bad: Large Occurrence) and the presence or absence of the change of the color of the plated surface (Good: Absence and Bad: Presence) were examined. Results are shown in Table 2. In addition, in a column of a "nozzle type" of Table 2, a separated type outside the pipe means a type (Comparatives 1 and 2) in which the plating solution injection nozzles are fixed to the main body of the pipe end seal mechanism individually and supplied the plating solution from the outside of the pipe via hoses individually. Additionally, in a column of a "nozzle type" of Table 2, a common type inside the pipe means a type (Examples 1, 2, and 3) which uses the disposition of the plating solution injection nozzle shown in FIG. 1.

TABLE 2

| Classification | Nozzle Type | Number of Nozzle | Upper Portion Atmosphere Opening Port | Unplating | Change of Color of Surface |
|---|---|---|---|---|---|
| Comparative Example 1 | Separated Type Outside Pipe | 1 | Absence | Bad | Bad |
| Comparative Example 2 | Separated Type Outside Pipe | 3 | Absence | Bad | Bad |
| Example 1 | Common Type Inside Pipe | 3 | Presence | Good | Good |
| Example 2 | Common Type Inside Pipe | 4 | Presence | Good | Good |
| Example 3 | Common Type Inside Pipe | 2 | Presence | Normal | Good |

As shown in FIG. 2, when the plating solution injection nozzle was individually provided outside the pipe (Comparative Examples 1 and 2), even though the number of the plating solution injection nozzles was 3, a uniform spiral jet could not be obtained, and unplated regions occurred.

On the other hand, when three or more plating solution injection nozzles were provided in common inside the pipe (Examples 1 and 2), it was understood that the unplated region did not occur. This was considered because bubbles remaining on the thread bottoms of the female screw were effectively removed by forming a uniform spiral jet between the female screw and the anode of the insoluble electrode.

In addition, it was confirmed that the plating solution was rapidly discharged by providing the atmosphere opening port at the position of the upper portion of the pipe and the change of the color of the surface of the electro plating layer did not occur.

Moreover, it was found that although the unplated regions slightly occurred in Example 3 (when the number of plating solution injection nozzles were two) of Table 2, it was level without problems, and removal effects of the bubbles were sufficient.

As understood from the results, in order to prevent the unplated regions from occurring due to the staying of the oxygen gas generated from the anode at the time of plating, the method applying the jet is considered. It is effective in a case of a flat shape only by providing the plating solution injection nozzle outside the pipe. However, in the spiral screw shape, bubbles stay on the thread bottoms and unplated regions occur. Even when the number of the plating solution injection nozzles is increased, a uniform jet is not obtained, and the unplated regions occur.

On the other hand, if the plurality of that is, two or more plating solution injection nozzles are provided in common inside the pipe, a uniform spiral jet can be formed between the female screw and the insoluble electrode, remaining bubbles on the thread bottoms are effectively removed, and occurrence of the unplated regions can be prevented. The number of the plating solution injection nozzles is preferably 3, and thus, occurrence of the unplated regions can be securely prevented. In addition, the plating solution is rapidly discharged by providing the atmosphere opening port, and the change of the color of the surface of the plated female screw does not occur.

DESCRIPTION OF REFERENCE NUMERALS AND SIGNS

0: steel pipe
0*a*: pipe end
0*a*-1: tip of pipe end
0*b*: female screw
0*c*: predetermined position
1: electro plating device
2: pipe inside seal mechanism
3: pipe end seal mechanism
3*a*: main body
3*b*: liquid discharge promotion mechanism (atmosphere opening port)
3*c*: liquid discharge port
4: insoluble electrode
5 and 7: plating solution feed mechanism
5*a*, 5*b*, and 5*c*: plating solution injection nozzle
7*a*, 7*b*, and 7*c*: plating solution injection nozzle
5*a*-1, 5*b*-1, and 5*c*-1: tip of plating solution ejection nozzle
7*a*-1, 7*b*-1, 7*c*-1: tip of plating solution injection nozzle
6: energizing bar

The invention claimed is:

1. An electro plating device which forms an electro plating layer on a surface of a female screw carved on an inner circumferential surface of a pipe end of a steel pipe, the electro plating device comprising:

a pipe inside seal mechanism which occludes an inner channel of the steel pipe at a position distanced from the female screw in a pipe axial direction of the steel pipe;

a tubular insoluble electrode which is disposed in the pipe end so as to be opposite to the female screw;

a plating solution feed mechanism which includes a plurality of nozzles which extend radially with a pipe axis of the steel pipe as a center, and is disposed outside the pipe end; and a pipe end seal mechanism which accommodates the nozzles thereinside and is mounted to the pipe end in a state where the pipe end seal mechanism closely contacts an outer circumferential surface of the pipe end, wherein when viewed in the pipe axial direction, a tip of each of the nozzles is positioned between the female screw and the insoluble electrode, and each of the nozzles injects the plating solution from an injection port formed on the tip toward a direction which intersects an extension direction of the nozzle, the direction being a rotational direction of a clockwise direction or a counterclockwise direction in which the pipe axis is the center, and wherein the tip of each of the nozzles is positioned at an outer portion of the steel pipe from a tip of the female screw in the pipe axial direction of the steel pipe.

2. The electro plating device according to claim 1, wherein each of the nozzles is perpendicular to the pipe axial direction or is inclined toward the pipe end side.

3. The electro plating device according to claim 2, wherein the plating solution feed mechanism includes three nozzles.

4. The electro plating device according to claim 3, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

5. The electro plating device according to claim 2, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

6. The electro plating device according to claim 1, wherein each of the nozzles is perpendicular to the pipe axial direction, and each of the nozzles injects the plating solution in a reference direction perpendicular to the pipe axial direction and the extension direction when viewed in the extension direction of the nozzle or injects the plating solution in a direction which is inclined from the reference direction to the pipe end side.

7. The electro plating device according to claim 6, wherein the plating solution feed mechanism includes three nozzles.

8. The electro plating device according to claim 7, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

9. The electro plating device according to claim 6, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

10. The electro plating device according to claim 1, wherein the plating solution feed mechanism includes three nozzles.

11. The electro plating device according to claim 10, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

12. The electro plating device according to claim 1, wherein the pipe end seal mechanism further includes:

a discharging port for discharging a used plating solution; and an atmosphere opening portion which is disposed at a position above the steel pipe in the pipe end seal mechanism and promotes discharging of the used plating solution.

* * * * *